US009338570B2

(12) United States Patent
Holzmann

(10) Patent No.: US 9,338,570 B2
(45) Date of Patent: May 10, 2016

(54) METHOD AND APPARATUS FOR AN INTEGRATED HEADSET SWITCH WITH REDUCED CROSSTALK NOISE

(71) Applicant: Nuvoton Technology Corporation, Hsinchu (TW)

(72) Inventor: Peter J. Holzmann, San Jose, CA (US)

(73) Assignee: NUVOTON TECHNOLOGY CORPORATION, Hsin-Chu (TW)

( * ) Notice: Subject to any disclaimer, the term of this patent is extended or adjusted under 35 U.S.C. 154(b) by 481 days.

(21) Appl. No.: 14/048,011

(22) Filed: Oct. 7, 2013

(65) Prior Publication Data

US 2015/0098579 A1 Apr. 9, 2015

(51) Int. Cl.

| | |
|---|---|
| ***H04R 29/00*** | (2006.01) |
| ***H04R 5/04*** | (2006.01) |
| *H04R 5/033* | (2006.01) |

(52) U.S. Cl.

CPC ..... *H04R 29/004* (2013.01); *H04R 5/04* (2013.01); *H04R 5/033* (2013.01); *H04R 2420/05* (2013.01)

(58) Field of Classification Search

CPC ..... H04R 3/00; H04R 3/002; H04R 2410/05
USPC ..... 381/17, 59, 71.1, 71.8, 94.1, 94.6, 94.9, 381/123, 375, 58, 71.6, 74, 77; 379/417
See application file for complete search history.

(56) References Cited

U.S. PATENT DOCUMENTS

| | | | | |
|---|---|---|---|---|
| 8,150,046 | B2 * | 4/2012 | Hansson | H04R 1/1033 381/58 |
| 8,917,882 | B2 * | 12/2014 | Miao | H04R 1/1041 381/77 |
| 2011/0268289 | A1 * | 11/2011 | Baranwal | H03F 3/181 381/74 |
| 2012/0237044 | A1 * | 9/2012 | Poulsen | H04R 1/1041 381/58 |
| 2014/0010398 | A1 * | 1/2014 | Wang | H04M 1/6066 381/375 |
| 2014/0029770 | A1 * | 1/2014 | Chien | H04R 3/00 381/123 |

* cited by examiner

*Primary Examiner* — Md S Elahee
(74) *Attorney, Agent, or Firm* — Kilpatrick Townsend & Stockton LLP

(57) ABSTRACT

An integrated audio signal processing circuit is described for reducing crosstalk noise in an integrated headset switch for a headset having two speakers, a microphone sharing a common ground. The audio signal processing circuit includes two audio amplifiers and also has two terminals configured to be either a microphone connection terminal or a headset ground connection terminal, respectively, depending on the type of the headset. An audio amplifier reference node is coupled to inputs of the audio amplifiers. The audio signal processing circuit has a first switch device responsive to a headset ground selection signal and configured to connect the audio amplifier reference node to the detected headset ground connection terminal. The audio signal processing circuit also has a second switch device responsive to the headset ground selection signal and configured to couple the detected headset ground connection terminal to a ground terminal of the audio processing circuit.

12 Claims, 5 Drawing Sheets

METHOD AND APPARATUS FOR AN INTEGRATED HEADSET SWITCH WITH REDUCED CROSSTALK NOISE

BACKGROUND OF THE INVENTION

The present invention relates generally to electronic circuits for audio systems. More particularly, embodiments of the present invention provide circuits and systems for an integrated headset switch with reduced crosstalk noise.

With the advancement of electronics and integrated circuits, great progress has also been made in audio systems used in entertainment, computer systems, communication, electronic games, and mobile computing devices, etc. In advanced audio systems with features such as stereo sound, 3-D sound, and noise cancelation, the demand for quality is even higher. The quality of an audio system is measured by many parameters, for example, frequency response, harmonic distortion, output power, noise, and crosstalk, etc.

In electronics, crosstalk occurs when a signal transmitted on one circuit or channel of a system creates an undesired effect in another circuit or channel. Crosstalk is usually caused by undesired coupling from one circuit to another and can be especially prevalent in audio systems that include multiple speakers and/or a microphone. For example, headphones are a pair of small loudspeakers that are designed to be held close to a user's ears. Headphones either have wires or have a wireless receiver for connection to a signal source such as an audio amplifier, radio, CD player, portable media player, or mobile phone. Modern headphones have been particularly widely sold and used for listening to stereo recordings. Headphones are also useful for video games that use 3D positional audio processing algorithms, as they allow players to better judge the position of an off-screen sound source.

Multiple speakers are also used in surround sound, which is a technique for enriching the sound reproduction quality of an audio source with additional audio channels from speakers that surround the listener. Typically this is achieved by using multiple discrete audio channels routed to an array of loudspeakers.

Modern headsets often include a microphone for voice inputs in applications such as mobile devices and computers. The inclusion of a microphone in a headset can further complicate performance issues including crosstalk.

As described below, an audio system having two or more speakers and a microphone often are susceptible to crosstalk noise. Therefore, improved techniques for reducing the crosstalk noise in an audio system are highly desired.

BRIEF SUMMARY OF THE INVENTION

The present invention relates generally to electronic circuits for audio systems. More particularly, embodiments of the present invention relate to circuits and systems for an integrated headset switch with reduced crosstalk noise. Merely, by way of example, embodiments of the present invention have been applied to a headset having two speakers and a microphone sharing a ground connection, but it would be recognized that the invention has a much broader range of applications and can be applied to other audio systems as well.

According to an embodiment of the present invention, an integrated audio signal processing circuit is described for reducing crosstalk noise in an audio system including, for example, a headset having a first and a second speakers, a microphone sharing a common ground. The audio signal processing circuit includes first, second, third, and fourth terminals for coupling to a headset having a first and a second speakers, a microphone, and a headset ground. The first and the second terminals are configured for providing a first and a second audio signals to the first and the second speakers, respectively. The third and the fourth terminals are configured to be either a microphone connection terminal or a headset ground connection terminal, respectively, depending on the type of the headset. The audio signal processing circuit also includes an audio jack detection circuit configured to detect the headset ground connection terminal and to provide a corresponding headset ground selection signal indicating whether the third or the fourth terminals is the headset ground connection terminal or the microphone connection terminal.

The audio signal processing circuit also has first and second audio amplifiers for providing the first and the second audio signals to the first and second terminals, respectively. An audio amplifier reference node is coupled to inputs of the first and the second audio amplifiers for providing a common mode signal. Further, the audio signal processing circuit has a first switch device responsive to the headset ground selection signal and configured to connect the audio amplifier reference node to the detected headset ground connection terminal. The audio signal processing circuit also has a second switch device responsive to the headset ground selection signal and configured to couple the detected headset ground connection terminal to a ground terminal of the audio processing circuit. In some embodiments, the audio signal processing circuit also includes a third switch device responsive to the headset ground selection signal and configured to couple the microphone connection terminal to a microphone bias circuit and a fourth switch device responsive to the headset ground selection signal and configured to couple the microphone connection terminal to a push button signal detection circuit.

As described above, in the headset, the first and the second speakers and the microphone are coupled to the headset ground, wherein, in the audio processing circuit. Therefore, the headset is susceptible crosstalk noise. In embodiments of the present invention, the first and the second switch devices are configured such that the differential voltage across the first speaker remains zero when the second speaker contains a non-zero signal, and such that the differential voltage across the second speaker remains zero when the first speaker contains a non-zero signal.

In some embodiments, the audio signal processing circuit also includes a signal processing circuit.

In some embodiments, the audio signal processing circuit also includes a microphone input amplifier configured for being coupled to the third and the fourth terminals of the headset for receiving an AC microphone input signal. In a specific embodiment, the microphone input amplifier is configured to be coupled to the third and fourth terminals of the headset through a first and a second blocking capacitors.

In some embodiments of the invention, the first switch device includes first and second MOS transistors. In another embodiment, the second switch device includes third and fourth MOS transistors.

According to another embodiment of the present invention, an audio system, includes a headset having a first and a second speakers, a microphone, and a headset ground. A headset plug has first, second, third, and fourth terminals for coupling the first and second speakers, the microphone, and the headset ground, respectively. An audio jack is configured for receiving the headset plug, and an audio signal processing circuit coupled to the audio jack. The audio signal processing circuit includes first, second, third, and fourth terminals for coupling to the headset through the audio jack and the headset plug.

The first and the second terminals are configured for providing a first and a second audio signals to the first and the second speakers, respective. The third and the fourth terminals are configured to be either a microphone connection terminal or a headset ground connection terminal, respectively, depending on the type of the headset. An audio jack detection circuit is configured to detect the headset ground connection terminal and to provide a corresponding headset ground selection signal. A first and a second audio amplifiers provide the first and the second audio signals to the first and second terminals, respectively. An audio amplifier reference node is coupled to inputs of the first and the second audio amplifiers for providing a common mode signal. The audio processing circuit also has a first switch device responsive to the headset ground selection signal and configured to connect the audio amplifier reference node to the detected headset ground connection terminal, and a second switch device responsive to the headset ground selection signal and configured to couple the detected headset ground connection terminal to a ground terminal of the audio processing circuit.

In some embodiments of the audio system, the an audio signal processing circuit also includes a third switch device responsive to the headset ground selection signal and configured to couple the microphone connection terminal to a microphone bias circuit for providing a bias to an electret microphone.

In another embodiment, the an audio signal processing circuit also has a fourth switch device responsive to the headset ground selection signal and configured to couple the microphone connection terminal to a push button signal detection circuit.

In another embodiment, the integrated audio signal processing circuit further includes a microphone input amplifier configured for coupling to the third and the fourth terminals of the headset for receiving an AC microphone input signal.

In yet another embodiment, the audio system also includes a first and a second blocking capacitors, wherein the microphone input amplifier is configured to be coupled to the third and fourth terminals of the headset through the first and the second blocking capacitors.

A further understanding of the nature and advantages of the present invention may be realized by reference to the remaining portions of the specification and the drawings.

DETAILED DESCRIPTION OF THE INVENTION

The description below refers to a series of drawing figures enumerated above. These diagrams are merely examples, and should not unduly limit the scope of the claims herein. In connection with the various aspects illustrated and described, one of ordinary skill in the art would recognize other variations, modifications, and alternatives.

Figure 1:
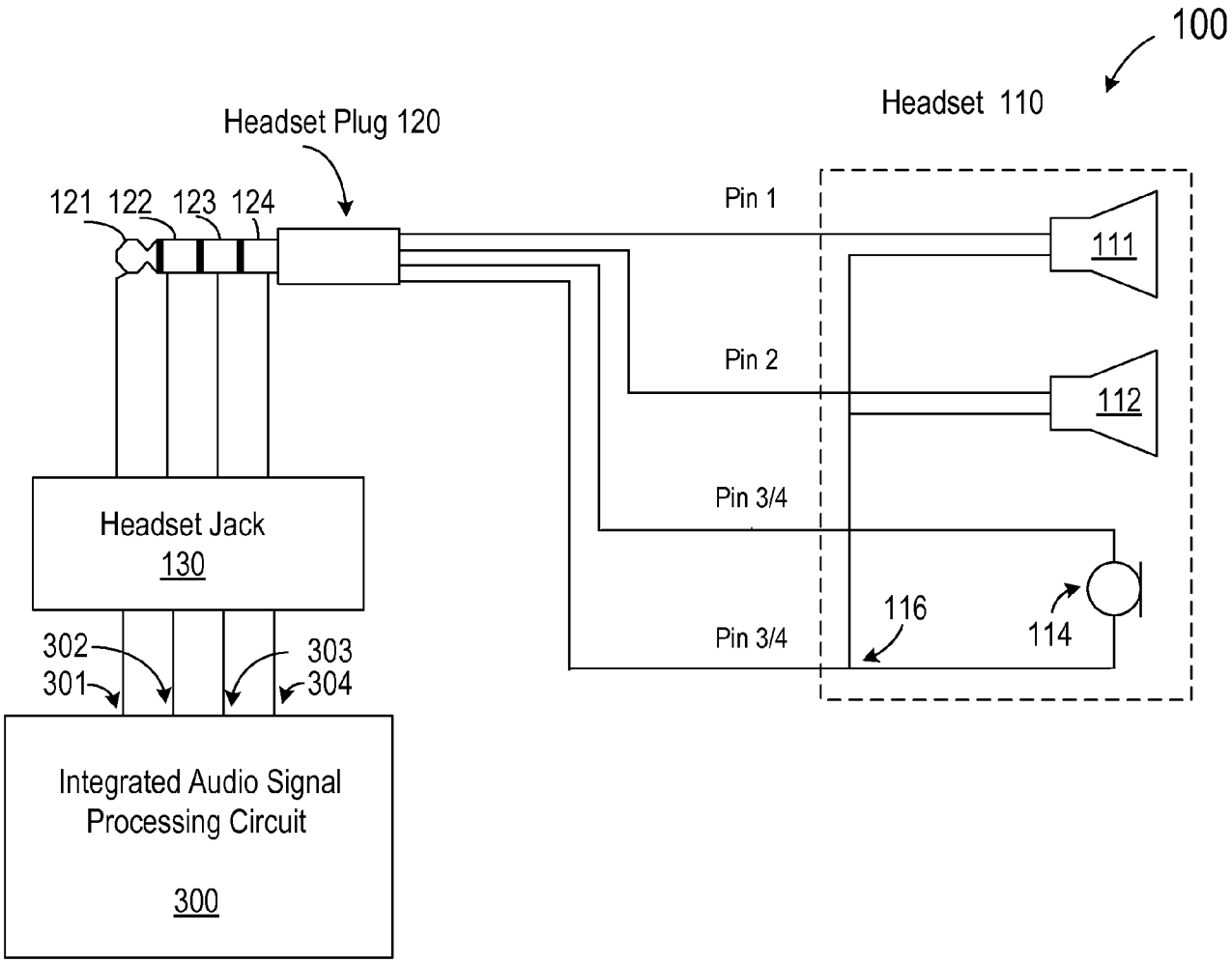
FIG. 1 is a simplified block diagram illustrating an audio system according to an embodiment of the present invention.

FIG. 1 is a simplified block diagram illustrating an audio system according to an embodiment of the present invention. As shown in FIG. 1, audio system 100 includes a headset 110 having a first speaker 111 and a second speaker 112, a microphone 114 and a ground 116. Audio system 100 also includes a headset plug 120 coupled to a headset jack 130, which in turn is coupled to an integrated audio signal processing circuit 300.

Headset plug 120 has four terminals, sometimes referred to as tip, ring 1, ring 2, and sleeve (TRRS) connectors. In headset plug 120, the first terminal 121 and the second terminal 122, connected to pin 1 and pin 2 of headset 110, are configured for providing a first and a second audio signals to the first and the second speakers, 111 and 112, respectively. The third and the fourth terminals of the headset plug, 123 and 124, connected to two pins both labeled pin 3/4, are configured to be coupled either to the microphone 114 or the ground 116 of the headset depending on the type of the headset plug. For example, FIG. 1 shows an OMTP (Open Mobile Terminal Platform) headset plug in which pin 3 is connected to the microphone, and pin 4 is connected to the headset ground 116. With pin 1 and pin 2 connected to the left and right speakers, respectively, an OMTP headset plug would have a L/R/M/G configuration. Alternatively, in a CTIA (Cellular Telephone Industries Association) headset, pin 4 is connected to the microphone, and pin 3 is connected to the headset ground. As a result, a CTIA headset plug would have an L/R/G/M configuration.

As shown in FIG. 1, audio jack or headset jack 130 is configured for receiving the headset plug 120 and provide connections to integrated audio signal processing circuit 300 at terminals 301, 302, 303, and 304.

Figure 2:
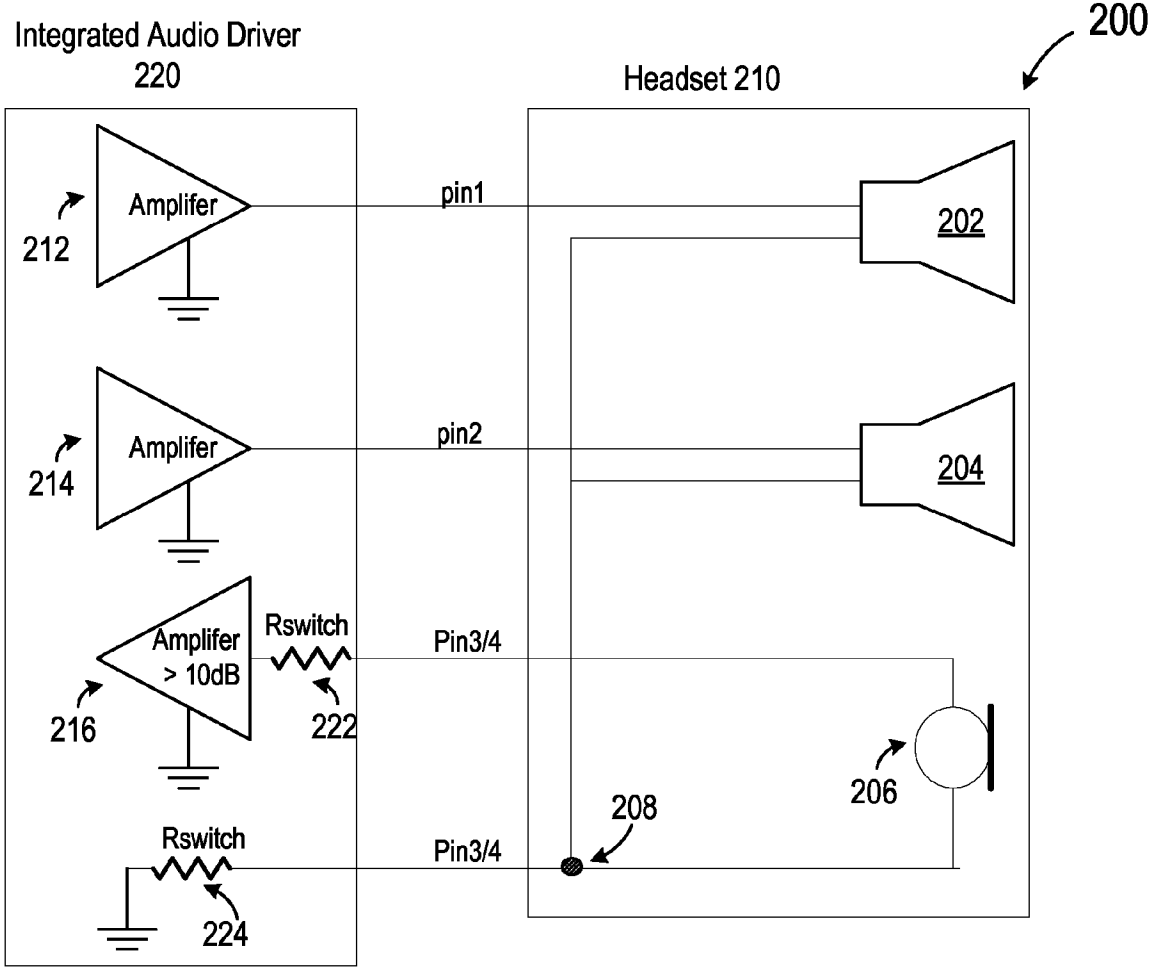
FIG. 2 is a schematic diagram illustrating crosstalk problems in a conventional audio system.

FIG. 2 is a schematic diagram illustrating crosstalk problems in a conventional audio system. As shown, audio system 200 includes a headset 210 having two speakers 202 and 204 and a microphone 206 driven by an audio driver 220 that includes a first amplifier 212, a second amplifier 214, and a third amplifier 216. In some applications, such as in a headset for a mobile device, the two speakers for the earpieces often share a ground connection with the microphone. As shown in FIG. 2, speakers 202 and 204 and microphone 206 share a common ground node 208 in the headset. This arrangement can be desirable because it can simplify the circuit and reduce pin count and cost.

As described above, different headsets can have different microphone and ground pin connections. Therefore, audio driver circuit needs to be able to switch between the different pin connections. These switches often have built-in resistance. As shown in FIG. 2, two switches Rswitch are shown by resistors 222 and 224. In FIG. 2 the headset ground 208 is shown connected to switch resistor 224. Alternatively, the headset ground 208 can also be connected to switch resistor 222. Resistances 222 and 224 can also include parasitic resistances. The switch arrangement allows the same audio circuit to be used with different headsets. However, it is also susceptible to crosstalk noise. For example, electrical signal in the circuit for speaker 202 may cause a voltage built up in resistance 224, and the resulting voltage at node 208 may cause crosstalk noise in speaker 204, and may also affect microphone 206. Conversely, electrical signal in the circuit of speaker 204 may lead to crosstalk noise in speaker 202, and may also affect microphone 206. Such crosstalk noise is highly undesirable, especially in high performance systems, such as 3-D sound or noise cancellation applications.

Therefore, there is a need for improved methods for the reduction of crosstalk noise in an audio system.

Figure 3:
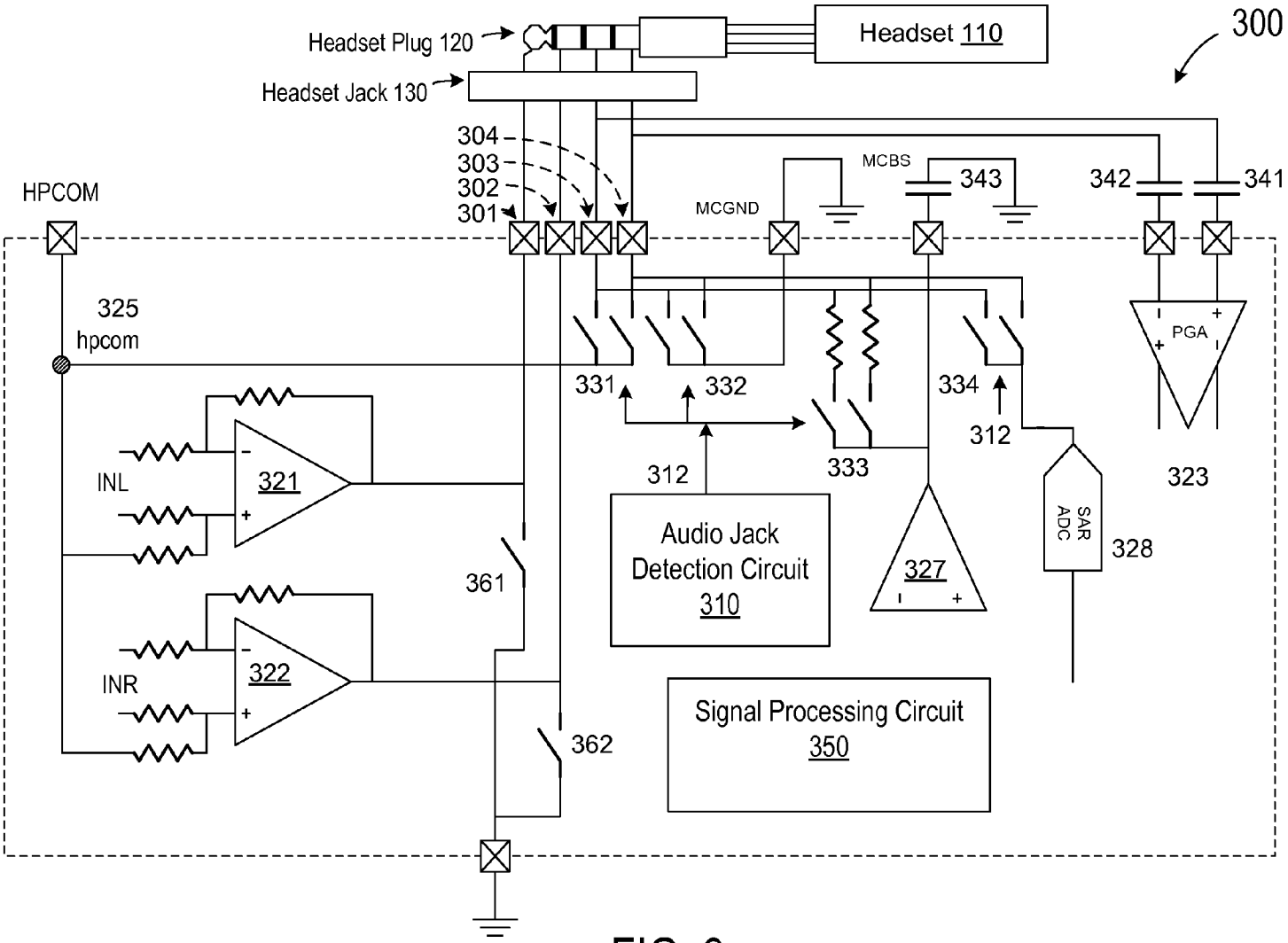
FIG. 3 is a schematic diagram illustrating an integrated audio signal processing circuit 300 according to an embodiment of the present invention.

FIG. 3 is a schematic diagram illustrating an integrated audio signal processing circuit 300 according to an embodiment of the present invention, which could be used in audio system 100 described above in FIG. 1 to reduce crosstalk noise. As shown in FIG. 3, audio signal processing circuit 300 is coupled to a headset 110 through a headset plug 120 and a headset jack 130. As described above in connection with FIG. 1, headset 110 has a first and a second speakers, a microphone, and a headset ground. Headset plug 120 has first, second, third, and fourth terminals for coupling the first and second speakers, the microphone, and the headset ground, respectively. Audio jack 130 is configured for receiving the headset plug.

According to embodiments of the present invention, integrated audio signal processing circuit 300 is configured for reducing crosstalk noise in an audio system including, for example, a headset having a first and a second speakers, and a microphone sharing a common ground, as depicted in FIGS. 1 and 2. As shown in FIG. 3, audio signal processing circuit 300 includes first, second, third, and fourth terminals 301, 302, 303, and 304 for coupling to a headset having a first and a second speakers, a microphone, and a headset ground. The first and the second terminals are configured for providing a first and a second audio signals to the first and the second speakers, respectively. The third and the fourth terminals are configured to be either a microphone connection terminal or a headset ground connection terminal, respectively, depending on the type of the headset.

Audio signal processing circuit also includes an audio jack detection circuit 310 configured to detect the headset ground connection terminal and to provide a corresponding headset ground selection signal 312, which indicates either terminal 303 or 304 is the headset ground connection terminal or the headset microphone connection terminal. In an embodiment, audio jack detection circuit 310 is configured to detect the ground connection by measuring the impedance between the terminals. For example, in some headset, the resistance between the speaker terminals and the ground terminals may have a different value than the resistance between the microphone terminal and the ground terminal. Of course, other conventional audio jack detection methods can also be used.

Audio signal processing circuit 300 also has first and second audio amplifiers 321 and 322 for providing the first and the second audio signals to the first and second terminals, 301 and 302, respectively. In FIG. 3, input signals INL and INR to audio amplifiers 321 and 322 are audio sources that typically come from an internal audio DAC (digital-to-analog converter), but could also come from an external source or other internal analog audio source. An audio amplifier reference node 325 (hpcom) is coupled to inputs of the first and the second audio amplifiers 321 and 322 for providing a common mode signal to the speakers.

Further, the audio signal processing circuit has a first switch device 331 responsive to the headset ground selection signal 312 and configured to connect the audio amplifier reference node hpcom to the detected headset ground connection terminal, either terminals 303 or 304. The audio signal processing circuit also has a second switch device 332 responsive to the headset ground selection signal 312 and configured to couple the detected headset ground connection terminal to a ground terminal MCGND of the audio processing circuit.

In some embodiments, the audio signal processing circuit also includes a third switch device (333) responsive to the headset ground selection signal 312 and configured to couple the microphone connection terminal, either terminals 303 or 304, to a microphone bias circuit 327). The microphone bias circuit typically requires a low noise high power supply rejection amplifier to provide a bias voltage MCBS to an electret microphone. The voltage is then supplied to the microphone through one of the resistors connected to switch device 333. In some embodiments, the audio signal processing circuit also includes a fourth switch device 334 responsive to the headset ground selection signal and configured to couple the microphone connection terminal, either terminals 303 or 304, to a push button signal detection circuit 328 for detecting push button signal, e.g., a Send/End signal in some headsets. The SAR ADC in push button signal detection circuit 328 is used to detect push buttons on the microphone pin and the SAR ADC data is processed by the logic circuits in order to detect valid push button presses.

As described above, in the headset, the first and the second speakers and the microphone are coupled to the headset ground. Further, the ground connections of first and second audio amplifiers are made through selection switch 332, which has finite resistances and is connected to either terminal 303 or terminal 304 depending on the type of the headset plug. Since switch 331 has a finite resistance, a current on one of the speakers can produce a voltage that would appear on the other speaker, because the ground is shared by second speaker. Therefore, the headset is susceptible to crosstalk noise. However, in embodiments of the invention, audio amplifier reference node hpcom is connected to the detected headset ground connection terminal as shown in FIG. 3. Further, the detected headset ground connection terminal is also connected to a ground terminal MCGND of the audio processing circuit. Therefore, any disturbance on from one of the speakers is duplicated on the other speaker. As a result, crosstalk noise between the speakers are eliminated or at least reduced. Therefore, in embodiments of the present invention, the first and the second switch devices are configured such that the differential voltage across the first speaker remains zero when the second speaker contains a non-zero signal, and such that the differential voltage across the second speaker remains zero when the first speaker contains a non-zero signal. For similar reasons, crosstalk between the microphone and the speakers can also be eliminated or reduced.

In some embodiments, the audio signal processing circuit also includes a signal processing circuit 350 that can include circuits such as a CODEC (coder/decoder) for processing audio signals and circuits for interfacing with audio equipment or a computer system. To simplify the drawing, connections to signal processing circuit 350 are omitted in FIG. 3.

In some embodiments, the audio signal processing circuit also includes a microphone input amplifier 323 PGA (programmable gain amplifier), which is configured for coupling to the third and the fourth terminals 303 and 304 of the headset for receiving an AC microphone input signal. The PGA output typically goes to an audio ADC for audio processing, but may also be used directly as an analog audio output. In a specific embodiment, the microphone input amplifier is configured to be coupled to the third and fourth terminals of the headset through a first and a second blocking capacitors 341 and 342.

In some embodiments, switch devices 301-304 in FIG. 3 are MOSFET devices. But they can also be implemented with other known electronic switches. In FIG. 3, switches 361 and 362 are used to define the left and right headset speaker voltages to ground at power up and power down conditions. In some embodiments, switches 361 and 362 and MOSFETs and are controlled by a separate control bit from an I2C (Inter-Integrated Circuit) interface or SPI (Serial Peripheral Interface) register. However, it can also be part of an automated sequence that controls the switch.

Figure 4:
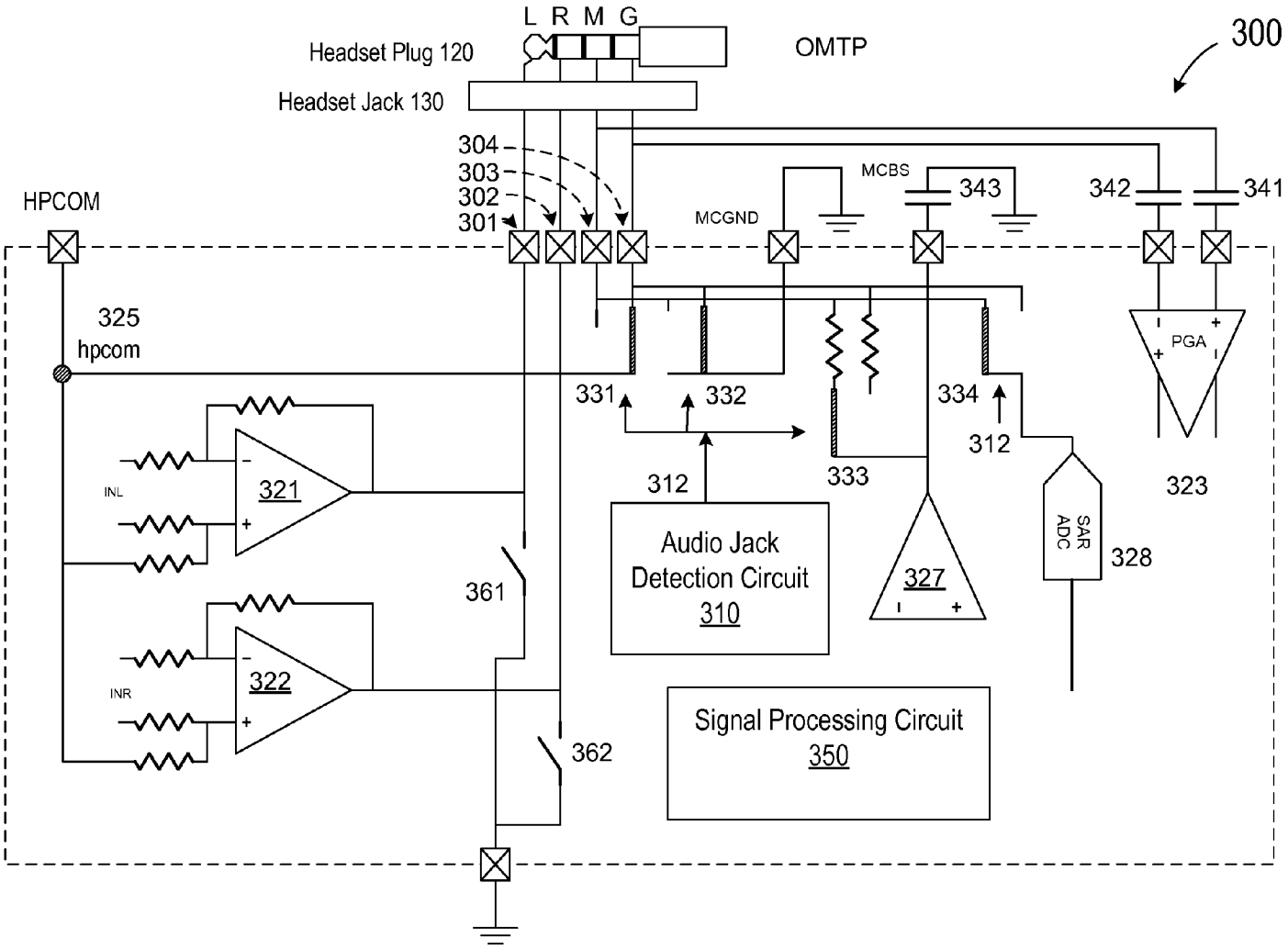
FIG. 4 is a schematic diagram illustrating the integrated audio signal processing circuit of FIG. 3 showing switch connections in a configuration of an OMTP (Open Mobile Terminal Platform) headset.

FIG. 4 is a schematic diagram illustrating integrated audio signal processing circuit 300 of FIG. 3 showing switch connections in a configuration of an OMTP (Open Mobile Terminal Platform) headset. It can be seen that pin 3 is connected to the microphone, and pin 4 is connected to the headset ground. With pin 1 and pin 2 connected to the left and right speakers, respectively, an OMTP headset plug has a L/R/M/G configuration. As shown in FIG. 4, switches 301-304 are set accordingly in response to the headset ground selection signal 312.

Figure 5:
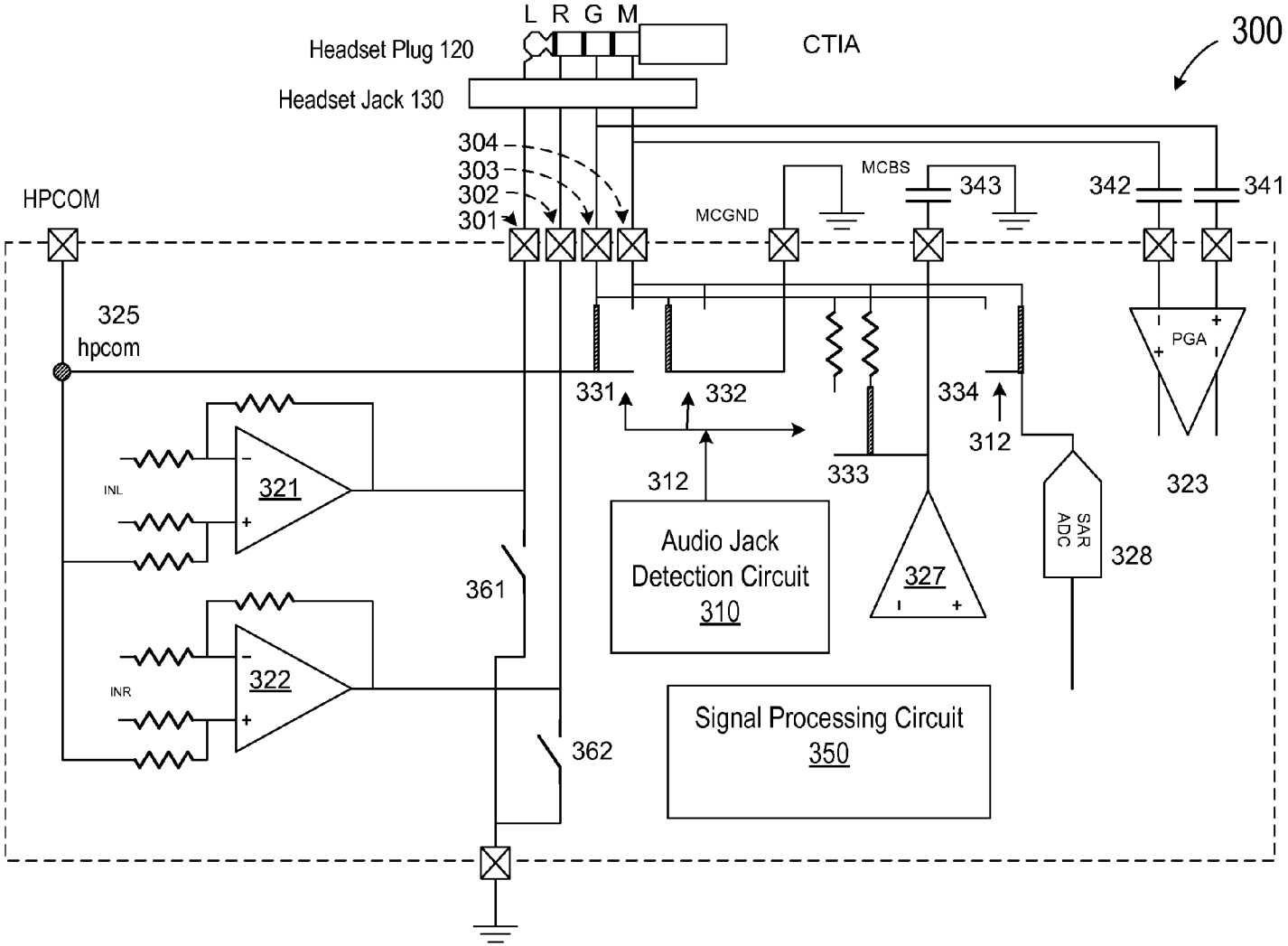
FIG. 5 is a schematic diagram illustrating the integrated audio signal processing circuit of FIG. 3 showing switch connections in a configuration of a CTIA (Cellular Telephone Industries Association) headset.

FIG. 5 is a schematic diagram illustrating the integrated audio signal processing circuit 300 of FIG. 3 showing switch connections in a configuration of a CTIA (Cellular Telephone Industries Association) headset, in which pin 4 is connected to the microphone, and pin 3 is connected to the headset ground. As a result, a CTIA headset plug would have an L/R/G/M configuration. As shown in FIG. 5, switches 301-304 are set accordingly in response to the headset ground selection signal 312.

As described above, in the headset, the first and the second speakers and the microphone are coupled to the headset ground. Therefore, the headset is susceptible crosstalk noise. Further, in the audio processing circuit, switch devices are used for connections to the selected headset ground terminal. The resistance of the switch devices also can cause crosstalk problems. In embodiments of the present invention, the internal headphone amplifier reference is tied to an internal ground reference that is derived from either pin 3 or pin 4 of the headset, such that the differential voltage across the left speaker remains zero when the right speaker contains a non-zero signal and such that the differential voltage across the right speaker remains zero when the left speaker contains a non-zero signal.

While the above is a description of specific embodiments of the invention, the above description should not be taken as limiting the scope of the invention. It is understood that the examples and embodiments described herein are for illustrative purposes only and that various modifications or changes in light thereof will be suggested to persons skilled in the art and are to be included within the spirit and purview of this application.

What is claimed is:

1. An audio signal processing circuit, comprising:

first, second, third, and fourth terminals for coupling to a headset having a first and a second speakers, a microphone, and a headset ground, wherein the first and the second terminals are configured for providing a first and a second audio signals to the first and the second speakers, respectively, wherein the third and the fourth terminals are configured to be either a microphone connection terminal or a headset ground connection terminal, respectively, depending on the type of the headset;

an audio jack detection circuit configured to detect the headset ground connection terminal and to provide a corresponding headset ground selection signal;

first and second audio amplifiers for providing the first and the second audio signals to the first and second terminals, respectively;

an audio amplifier reference node coupled to inputs of the first and the second audio amplifiers for providing a common mode signal;

a first switch device responsive to the headset ground selection signal and configured to connect the audio amplifier reference node to the detected headset ground connection terminal;

a second switch device responsive to the headset ground selection signal and configured to couple the detected headset ground connection terminal to a ground terminal of the audio processing circuit;

a third switch device responsive to the headset ground selection signal and configured to couple the microphone connection terminal to a microphone bias circuit; and a fourth switch device responsive to the headset ground selection signal and configured to couple the microphone connection terminal to a push button signal detection circuit.

2. The audio signal processing circuit of claim 1, further comprising a signal processing circuit.

3. The audio signal processing circuit of claim 1, wherein, in the headset, the first and the second speakers and the microphone are coupled to the headset ground, wherein, in the audio processing circuit, the first and the second switch devices are configured such that the differential voltage across the first speaker remains zero when the second speaker contains a non-zero signal, and such that the differential voltage across the second speaker remains zero when the first speaker contains a non-zero signal.

4. The audio signal processing circuit of claim 1, further comprising a microphone input amplifier configured for being coupled to the third and the fourth terminals of the headset for receiving an AC microphone input signal.

5. The audio signal processing circuit of claim 4, wherein the microphone input amplifier is configured to be coupled to the third and fourth terminals of the headset through a first and a second blocking capacitors.

6. The audio signal processing circuit of claim 1, wherein the first switch device comprises first and second MOS transistors.

7. The audio signal processing circuit of claim 1, wherein the second switch device comprises third and fourth MOS transistors.

8. An audio system, comprising:

a headset having a first and a second speakers, a microphone, and a headset ground;

a headset plug having first, second, third, and fourth terminals for coupling the first and second speakers, the microphone, and the headset ground, respectively;

an audio jack configured for receiving the headset plug;

an audio signal processing circuit coupled to the audio jack, the audio signal processing circuit including:

first, second, third, and fourth terminals for coupling to the headset through the audio jack and the headset plug, wherein the first and the second terminals are configured for providing a first and a second audio signals to the first and the second speakers, respectively, wherein the third and the fourth terminals are configured to be either a microphone connection terminal or a headset ground connection terminal, respectively, depending on the type of the headset;

an audio jack detection circuit configured to detect the headset ground connection terminal and to provide a corresponding headset ground selection signal;

first and second audio amplifiers for providing the first and the second audio signals to the first and second terminals, respectively;

an audio amplifier reference node coupled to inputs of the first and the second audio amplifiers for providing a common mode signal;

a first switch device responsive to the headset ground selection signal and configured to connect the audio amplifier reference node to the detected headset ground connection terminal; and a second switch device responsive to the headset ground selection signal and configured to couple the detected headset ground connection terminal to a ground terminal of the audio processing circuit.

9. The audio system of claim 8, wherein the an audio signal processing circuit further comprises a third switch device responsive to the headset ground selection signal and configured to couple the microphone connection terminal to a microphone bias circuit for providing a bias to an electret microphone.

10. The audio system of claim 8, wherein the an audio signal processing circuit further comprises a fourth switch device responsive to the headset ground selection signal and configured to couple the microphone connection terminal to a push button signal detection circuit.

11. The audio system of claim 8, wherein the integrated audio signal processing circuit further comprises a microphone input amplifier configured for being coupled to the third and the fourth terminals of the headset for receiving an AC microphone input signal.

12. The audio system of claim 8, further comprising a first and a second blocking capacitors, wherein the microphone input amplifier is configured to be coupled to the third and fourth terminals of the headset through the first and the second blocking capacitors.

* * * * *